US009121145B2

(12) United States Patent
Berning et al.

(10) Patent No.: US 9,121,145 B2
(45) Date of Patent: Sep. 1, 2015

(54) BUILDING MACHINE

(75) Inventors: Christian Berning, Zülpich (DE); Peter Busley, Linz/Rhein (DE); Günter Hähn, Königswinter (DE); Thomas Kramer, Königswinter (DE)

(73) Assignee: Wirtgen GmbH (DE)

( * ) Notice: Subject to any disclaimer, the term of this patent is extended or adjusted under 35 U.S.C. 154(b) by 1156 days.

(21) Appl. No.: 12/070,352

(22) Filed: Feb. 15, 2008

(65) Prior Publication Data

US 2008/0216021 A1 Sep. 4, 2008

(30) Foreign Application Priority Data

Feb. 17, 2007 (DE) ..... 10 2007 007 970

(51) Int. Cl.
*E01C 23/088* (2006.01)
*E01C 19/00* (2006.01)

(52) U.S. Cl.
CPC ..... *E01C 23/088* (2013.01); *E01C 19/00* (2013.01)

(58) Field of Classification Search
CPC ..... E01C 19/004; A01B 79/005
USPC ..... 701/50
See application file for complete search history.

(56) References Cited

U.S. PATENT DOCUMENTS 4,368,824 A * 1/1983 Thomasson ..... 212/278
5,359,516 A * 10/1994 Anderson ..... 701/50

(Continued)

FOREIGN PATENT DOCUMENTS

CN 1166556 A 12/1997
CN 1386152 A 12/2002

(Continued)

OTHER PUBLICATIONS

EPO Office Action dated Sep. 10, 2010 in corresponding application EP 08002232 with English translations of portions thereof. (not prior art).

(Continued)

*Primary Examiner* — Thomas B Will
*Assistant Examiner* — Joel F. Mitchell
(74) *Attorney, Agent, or Firm* — Lucian Wayne Beavers; Patterson Intellectual Property Law, PC

(57) ABSTRACT

The invention relates to a building machine, in particular a road-building machine, having running gear and a chassis which is fitted with a working unit which has one or more implements. The building machine has a stored-program control device for controlling the implements of the working unit and a device for displaying operational variables or operational states in the form of characters or images. In addition to the stored-program control device, the building machine has a centralized data processing device which is embodied in such a way that operational variables or operational states can be displayed as characters or images with the device for displaying operational variables or operational states. The exchange of data between the stored-program control device and the centralized data processing device is carried out via a first data bus, while the exchange of data between the data processing device and the device for displaying operational variables or operational states is carried out via a second data bus.

21 Claims, 2 Drawing Sheets

(56) References Cited

U.S. PATENT DOCUMENTS

| | | | | |
|---|---|---|---|---|
| 5,884,205 | A * | 3/1999 | Elmore et al. | 701/50 |
| 5,897,600 | A * | 4/1999 | Elmore et al. | 701/50 |
| 5,908,459 | A | 6/1999 | Röwer et al. | |
| 5,924,371 | A * | 7/1999 | Flamme et al. | 111/177 |
| 5,998,944 | A * | 12/1999 | Clutter et al. | 318/141 |
| 6,079,340 | A * | 6/2000 | Flamme et al. | 111/178 |
| 6,119,442 | A * | 9/2000 | Hale | 56/10.2 H |
| 6,167,337 | A * | 12/2000 | Haack et al. | 701/50 |
| 6,466,850 | B1 * | 10/2002 | Hilgart | 701/50 |
| 6,480,773 | B1 * | 11/2002 | Hilgart | 701/50 |
| 6,665,601 | B1 | 12/2003 | Nielsen | |
| 6,718,245 | B2 | 4/2004 | Watanabe et al. | |
| 6,904,348 | B2 * | 6/2005 | Drummond et al. | 701/49 |
| 6,990,399 | B2 * | 1/2006 | Hrazdera et al. | 701/50 |
| 7,599,762 | B2 * | 10/2009 | Discenzo et al. | 701/1 |
| 7,756,623 | B2 * | 7/2010 | Jarrett et al. | 701/50 |
| 7,848,861 | B2 * | 12/2010 | Pollock et al. | 701/29 |
| 2002/0082753 | A1 * | 6/2002 | Guskov et al. | 701/2 |
| 2002/0138188 | A1 | 9/2002 | Watanabe et al. | |
| 2002/0190682 | A1 | 12/2002 | Schempf et al. | |
| 2004/0230358 | A1 * | 11/2004 | Stam et al. | 701/49 |
| 2005/0004735 | A1 * | 1/2005 | Kelly et al. | 701/50 |
| 2006/0060650 | A1 | 3/2006 | Inoue et al. | |
| 2006/0241837 | A1 * | 10/2006 | Jarrett et al. | 701/50 |

FOREIGN PATENT DOCUMENTS

| | | | |
|---|---|---|---|
| DE | 9301031 | U1 | 5/1994 |
| DE | 9301031 | U1 | 7/1994 |
| DE | 196 05 926 | | 5/1997 |
| EP | 1302600 | A1 | 4/2003 |
| JP | 0477608 | U | 7/1992 |
| JP | 2004316279 | A | 11/2004 |
| JP | 2006222611 | A | 8/2006 |
| WO | WO 2006/094795 | | 9/2006 |

OTHER PUBLICATIONS

Decision to Grant EP 1959056, with English language claims (6 pages) (not prior art).

Wikipedia printout re "ISO 11783" (1 page) (admitted to be prior art).

CAN Newsletter, Sep. 2003, "CAN-based tractor—agricultural implement communication ISO 11783" (4 pages).

* cited by examiner

BUILDING MACHINE

RELATED APPLICATION

This application claims priority under 35 U.S.C. §119 or 365 to German Application No. DE 10 2007 007 970.4-25, filed Feb. 17, 2007. The entire teachings of the above application are incorporated herein by reference.

TECHNICAL FIELD

The invention relates to a building machine, in particular a road-building machine having running gear and a chassis which is fitted with a working unit which has one or more implements.

BACKGROUND

Building machines of different designs are known for civil engineering projects both above and below ground. For building roads, self-propelling road-building machines are used which are distinguished by the fact that they have a chassis and running gear. The chassis is fitted with a working unit which has one or more implements. In this context, working unit is to be understood as the device with which the work which is necessary to build the road can be carried out. For this purpose, the working unit has one or more implements with which the individual working steps which are necessary to build the road can be carried out.

Road-building machines are, for example, road milling machines which economically remove damage to road surface coverings. The road milling machines have, for this purpose, a milling device, for example a milling roller with milling cutters, and a conveyor device for feeding the milled-away road surface covering. The running gear of the road miller can have sets of wheels or caterpillar tracks.

In order to control the implements of the working unit, the known building machines generally have a stored-program controller, which is an electronic assembly which is used in automation technology for open-loop and closed-loop control functions. The stored-program control device has inputs and outputs and a memory for a program according to which the open-loop and closed-loop control functions are carried out.

In addition to the stored-program control device, the known building machines generally have a device for sensing operational variables or operational states which include, for example, the oil pressure or the coolant temperature of the diesel engine for driving the building machine, or in the case of a road milling machine, for example the advancing speed and the position of the milling roller with which the milling depth is predefined. In order to sense the operational variables or operational states, the device has, for example, pressure sensors, temperature sensors, position switches or limit switches, rotational speed signal transmitters or the like, whose analogue or digital signals are applied as input signals to the input of the stored-program control device. The signals for controlling, for example pneumatic or hydraulic valves, mechanical or electrical switches or the like, with which in turn the implements of the working unit are controlled, are present at the output of the control device as output signals.

Furthermore the building machines have a device for inputting operational variables or operational states, for example the desired advancing speed of the building machine. The input device can comprise various switches and a keyboard which are arranged on an operator control panel at an operator control location on the building machine.

In addition to the input device, the building machines have a device for displaying operational variables or operational states in the form of characters or images in order to inform the operator continuously about the operational variables or operational states.

The display of the operational variables or operational states in the form of characters or images takes place in the known building machines in such a way that the output signals of the stored-program control device which are relevant to the operational parameters or operational states are transmitted via a data bus to the operator control location at which the signals which are necessary for the display in the form of characters or images and which are displayed on a monitor are obtained from said output signals.

The devices for displaying characters or images of the known building machines are information systems which display operational variables or operational parameters in graphic form, for example with bar graphs or pictograms (icons). The bar graphs and pictograms are displayed in the known devices in pixels, in which case the display is monochrome. The known devices have the hardware and software which is necessary for the display of the bar graphs and pictograms. The relatively complex programming of the pixel display is carried out at the works end, but can also be modified by the customer.

SUMMARY

The disadvantage with the known building machines is that the display of the operational variables or operational states in the form of characters or images at the operator control location in the known building machines requires a relatively complex display unit. It is also disadvantageous that the display unit whose housing has relatively large dimensions is subjected to relatively large mechanical stresses at the operator control location due to vibrations and heat or cold as well as dust and dirt.

Furthermore, it is disadvantageous that a plurality of operator control locations at the building machine make it necessary to have a plurality of complex display units which must each have all the components which are necessary for it.

Furthermore, the low degree of flexibility of the known display units proves disadvantageous, and it results from the fact that the display unit is tailored to the respective application. Consequently, another application means the use of a new display unit or of a new program which has to be written specifically for the respective display unit. Changes can arise here not only from technical innovations but also from the particular requirements of customers which make it necessary to use different display units and different programs.

Embodiments of the invention are directed to providing a building machine which permits operational variables or operational states to be displayed in the form of characters or images with a high degree of flexibility and a low degree of technical complexity at one or more operator control locations on the machine.

A building machine according to the invention is distinguished by the fact that, in addition to the stored-program control device, a centralized data processing device is provided which is embodied in such a way that operational variables or operational states can be displayed as characters or images on the device for displaying operational variables or operational states. The generation of the signals which are necessary for displaying the characters or images is therefore not carried out in the display unit at the operator control location at which the characters or images are displayed but rather centrally in the data processing device. In order to display the operational variables or operational states at the operator control location, just one device with which the characters or images which are generated in the centralized data processing device can be displayed is required. A conventional screen (display) is sufficient for this.

In order to exchange data between the stored-program control device and the centralized data processing device, at least a first data bus is provided which operates according to a first data transmission method, while in order to exchange data between the centralized data processing device and the device for displaying operational variables or operational states at least a second data bus is provided which operates according to a second data transmission method which differs from the first data transmission method according to which the first data flow operates.

While the data which relates, for example, to the control of the building machine, for example the data which specifies the oil pressure and the coolant temperature or the position of the milling roller, is exchanged using the at least first data bus, the data which relates to the display of the characters or images is exchanged over the at least one second data bus. Exchange of data over the first data bus generally requires an event-oriented transmission of the data, for example when there is a change in the advancing speed or a change in the direction of travel of the building machine, while the exchange of the data over the second data bus requires a continuous transmission of data in order to be able to inform the operator continuously about the operational variables or operational states.

It is advantageous that the two buses for transmitting data can be adapted to the respective requirements. For the exchange of data between the centralized data processing device and the device for displaying the operational variables or operational states it is therefore possible to use a bus which permits signals to be transmitted with a high degree of reliability, even over long distances.

The building machine according to the invention makes it possible to use standard software for displaying the characters or images, which permits a high degree of flexibility. Adaptation to new technologies or to different customer requirements can be carried out easily by reading in the new software without the device for displaying the operational variables or operational states, which can comprise a plurality of screens (displays) having to be replaced.

Furthermore, the functional reliability is increased by virtue of the fact that the centralized data processing device with the sensitive electronic components can be arranged at a safe location on the building machine. Although the device for displaying the characters or images may possibly have to be mounted at a location at which the device is subjected to mechanical stresses through vibrations and heat or cold as well as dust and dirt, this is less problematic since the device does not contain the sensitive electronic components. The dimensions of the housing of the device for displaying the characters or images can also be small. For example, a flat liquid crystal display (LCD) is sufficient.

Whereas in the prior art the display units have a large number of inputs and outputs, for example various interfaces such as CAN buses or else an RS 232 interface, an input for the reception of the video signals is sufficient in the device for displaying the characters or images of the building machine according to the invention. For this reason it is possible to accommodate the device in a compact, hermetically sealed housing from which only one connecting cable is led out for communication with the centralized data processing device. A small and robust unit is therefore obtained.

If the operational variables or operational states are to be displayed at a plurality of operator control locations, only a relatively low degree of additional technical complexity is necessary since it is possible to have recourse to a centralized data processing device.

In one preferred embodiment of the building machine according to the invention, the at least one first data bus is a CAN (Controller Area Network) bus, which is an asynchronous serial bus system which has been developed for networking control units in motor vehicles. The CAN bus allows the length and number of cable harnesses to be reduced, therefore permitting a saving in weight.

In a further preferred embodiment, the at least one second data bus is an LVDS (Low Voltage Differential Signalling) bus which is an interface standard for high speed data transmission and is specified according to ANSI/TIA/EIA.

A particularly preferred embodiment provides for the centralized data processing device to have a main processor for carrying out computing operations, for example a commercially available microprocessor, and a graphic unit for controlling the display of characters or images for the device for displaying operational variables or operational states.

The device for displaying the operational variables or operational states may be a conventional monitor, for example a liquid crystal display (LCD), in particular a TFT display.

The device for inputting operational parameters or operational states may be embodied in different ways. The input device preferably has a plurality of switches and/or one or more keypads, while one or more input devices can be provided on the building machine.

A further, particularly preferred embodiment of the building machine provides a device for recording images at one or more locations on the building machine. For example, cameras with which the working sequence can be monitored at different locations can be arranged at one or more locations on the building machine.

While a first alternative embodiment has direct communication of the recording device with the device in order to display the operational variables or operational states, in particular with the monitor, a second alternative embodiment provides an exchange of data between the recording device and the centralized data processing device. This has the advantage that image processing can take place in the centralized data processing device. It is possible, for example, to assign the individual images of the individual cameras to different displays or to display a plurality of images on one display.

In a further particularly preferred embodiment the stored-program control device interacts with the centralized data processing unit in such a way that a predefined display of characters or images, assigned to the respective operational variable or the respective operational state, can be displayed on the device for displaying operational variables or operational states as a function of a specific operational variable or a specific operational state.

If the device for sensing operational variables or operational states has a device for sensing a change in the direction of travel of the building machine, the stored-program control device interacts with the centralized data processing device in such a way that, before the change in the direction of travel, a first display of characters or images is displayed, and after the change in the direction of travel, a second display of characters or images is displayed. Images can for example be displayed at different locations on the building machine depending on the direction of travel. The changeover of the display then takes place fully automatically when the direction of travel changes.

The centralized data processing device preferably has at least one interface for communication with at least one external unit. This interface may be, for example, a USB interface, an RS 232 interface or the like. With these interfaces it is possible, for example, to connect further commuting units for repair purposes and diagnostic purposes or printers or the like.

BRIEF DESCRIPTION OF THE DRAWINGS

The foregoing will be apparent from the following more particular description of example embodiments of the invention, as illustrated in the accompanying drawings in which like reference characters refer to the same parts throughout the different views. The drawings are not necessarily to scale, emphasis instead being placed upon illustrating embodiments of the present invention.

DETAILED DESCRIPTION

Figure 1:
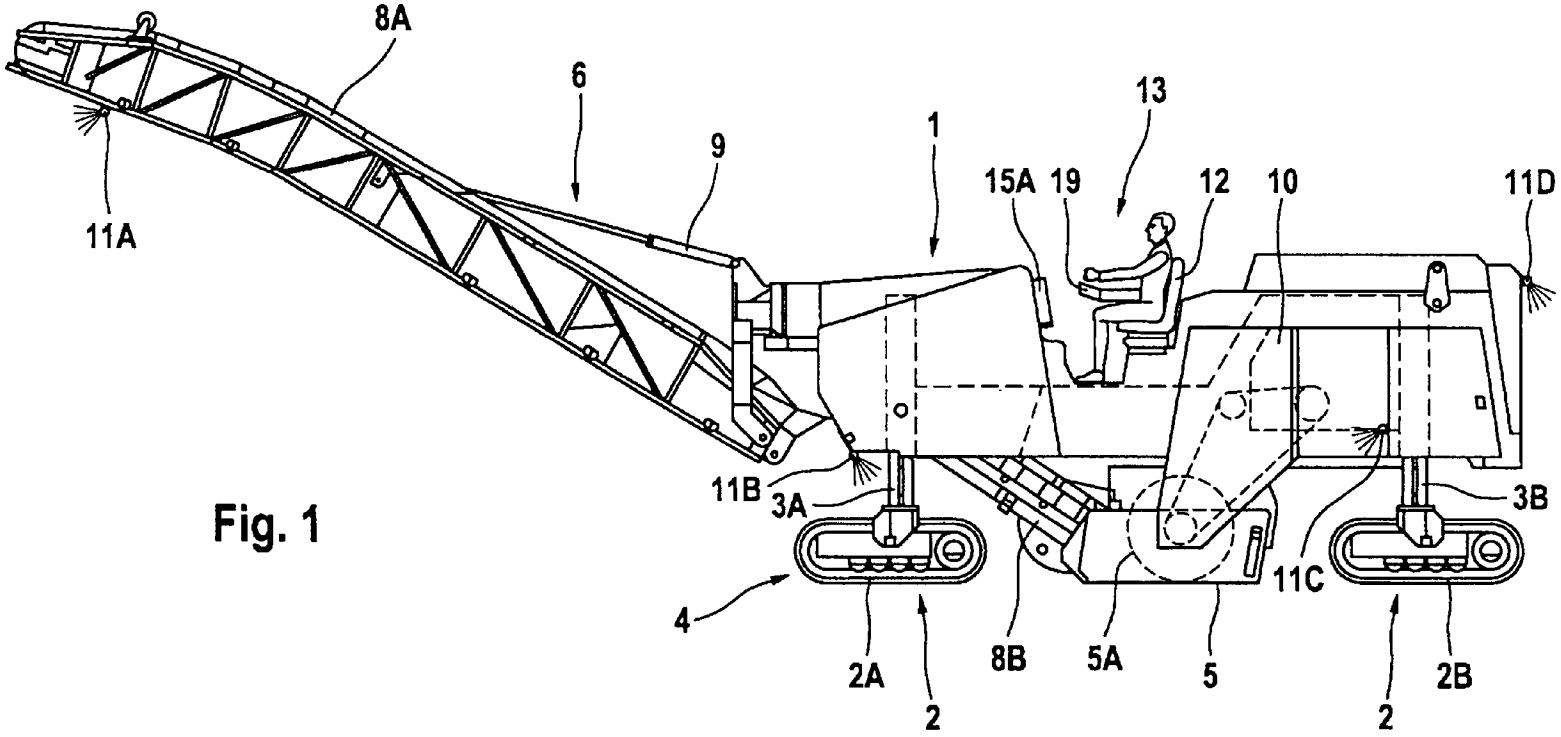
FIG. 1 shows an example of a road milling machine as a building machine in a simplified illustration.

FIG. 1 shows components of a road milling machine in a side view. The road milling machine has a chassis 1 and a running gear 2. The running gear 2 of the milling machine comprises four caterpillar track units 2A, 2B which are arranged at the front and rear on each side of the chassis 1. The chassis 1 and a running gear 2 are connected to one another by means of piston/cylinder arrangements 3A, 3B, with the result that each set of caterpillar tracks is vertically adjustable.

The chassis 1 of the milling machine is fitted with a working unit 4 (only indicated in the illustration) which has various implements. One of the implements of the milling machine is a milling device 5 which is arranged below the chassis and another implement is a conveyor device 6 which is arranged at the front side of the machine.

The milling device 5 has a milling roller 5A which is equipped with milling cutters. The milling roller 5A is vertically adjustable by means of the piston/cylinder arrangements 3A, 3B in order to be able to set a predefined milling depth. The conveyor device 6 has a first conveyor belt 8A which is attached to the chassis 1 and can be pivoted by means of a piston/cylinder arrangement 9, and a second conveyor belt 8B.

The road milling machine furthermore has a diesel engine 10 which is arranged within the chassis and which is only indicated in the illustration.

Furthermore, the milling machine has a large number of sensors, for example pressure sensors, temperature sensors etc. as well as actuators, for example hydraulic or pneumatic valves or relays, in order to be able to control the individual implements of the working unit. These sensors or actuators which are arranged at different locations are not illustrated in FIG. 1.

In order to take images, the road milling machine has a device 11 which comprises a total of four cameras 11A, 11B, 11C and 11D. The individual cameras are arranged at different locations on the milling machine.

While the milling machine is operated, the road surface covering is removed with the milling roller 5A of the milling device 5, with the milled material being loaded onto a lorry by means of the conveyor belt 8 of the conveyor device 6.

The camera 11A on the conveyor device 6 is used to monitor the loading of the lorry, the camera 11B to monitor the surface to be processed immediately in front of the milling device 5, the camera 11C to monitor the result of the work and the camera 11D to monitor the area behind the machine. The driver of the machine is seated on a driver's seat 12 in the driver's stand 13.

An example device for controlling the building machine according to the invention and for inputting and displaying operational variables or operational states is described below in detail with reference to FIG. 2, in which the description of the control and display device refers to the road milling machine which is described with reference to FIG. 1, in order to clarify the functioning of the individual components using examples. However, it is to be noted that the device shown in FIG. 2 can be provided in all types of building machines and as a basic illustration it goes beyond what is possible in terms of working processes with the road milling machine in FIG. 1.

The control, input and display device according to the invention comprises a device 14 for controlling the road milling machine and a device 15 for displaying operational variables or operational states in the form of characters or images.

The control device 14 is arranged at a protected location within the chassis 1 of the machine. The device 15 for displaying characters or images has a plurality of display units 15A, 15B which are arranged at different locations on the building machine. In the exemplary embodiment of the road milling machine in FIG. 1, a display unit 15A is located in the field of vision of the driver of the machine in the driver's stand 13.

The control device 14 has a stored-program control device 16 and a centralized data processing device 17. The stored-program control device 16 (SPS) performs the actual control of the road milling machine. The term SPS is an acronym for the German term speicherprogrammierbare Steuerung and is also commonly known in the United States as a Programmable Logic Controller of PLC. The design and functioning of a stored-program control device or PLC are known to a person skilled in the art. The control device receives data from the sensors of the building machine, processes this data and transmits data to the actuators of the building machine. The data can be divided into different groups which are designated in FIG. 1. This data includes the data which relates to the machine 16*a*, the operator control 16*b*, the diagnostics 16*c* and the programming 16*d*. For example, the stored-program control device receives the output signals of the temperature sensor of the road milling machine for the measurement of the coolant temperature of the diesel engine 10 or of the pressure sensor in order to measure the oil pressure or a position signal transmitter for acquiring the position of the milling roller 5A or the position of the conveyor belt 8 as well as a direction of travel signal transmitter for acquiring the direction of travel.

The centralized data processing device 17 comprises a main processor 17A and a graphic unit 17B. The central processing device 17 is connected to the stored-program control device 16 over a plurality of CAN buses 18A to 18D, one of which transmits in each case the data assigned to a specific group of data. For example, the data bus 18A is used to transmit the data relating to the diesel engine, for example the coolant temperature or the oil pressure, while the data bus 18B is used to transmit the data relating to the operator control of the machine. The CAN bus operates according to the CSMA/CA method which permits reliable transmission of data even with relatively long lengths of line.

In order to input operational variables or operational states, for example the advancing speed, direction of travel or milling depth, the road milling machine has a device 19 which is also arranged in the field of vision of the driver of the machine at the driver's stand 13, next to the side of the driver's seat 12. The device 19 has a plurality of switches and/or a keypad. The data which relates to the machine and the operator control, but also the data which relates to the diagnostics or the programming can be displayed on the display units 15A, 15B in an easily understood fashion in the form of characters or images.

All the data is processed in the main processor 17A. The main processor 17A also has further interfaces, for example a USB interface USB for connection of a data memory, a Bluetooth connection or a printer. Furthermore, an RS 232 interface is provided to which, for example, a printer or a PC for programming can be connected. Furthermore, the main processor permits cable-bound data network technology for local data networks (Ethernet).

The main processor 17A communicates with the graphic unit 17B over an internal bus. The graphic unit 17B controls the screen display of the display units 15A, 15B. For this purpose the graphic unit generates the necessary video signals, permitting characters and images to be displayed. The design and function of such a graphic unit which is also referred to as a graphic card in a PC, are known to a person skilled in the art.

The display units 15A and 15B each have a monitor 15A', 15B', preferably a liquid crystal (LC) display, in particular a TFT display. The design and method of functioning of such a display unit are known to a person skilled in the art. The display units are basically conventional screens (monitor).

In addition to the display, each display unit has an operator control unit 15A", 15B" with which the building machine can be operated. The operator control units 15A", 15B" for inputting specific machine commands communicate with the centralized stored-program control device 16 or the centralized data processing device.

In the present exemplary embodiment, the operator control unit 15A" is accommodated in the housing of the monitor 15A' of the display unit 15A while the operator control unit 15B" is a separate unit which is accommodated in another housing.

In addition to the operator control units for controlling the machine, the display units can also have regulators or knobs with which the display units themselves can be controlled, for example the brightness or contrast can be set.

The display units 15A, 15B are connected to the graphic unit 17B via, in each case, an LVDS bus 20A and 20B in order to be able to transmit the video signals. The LVDS bus can be used to transmit the video signals over long line lengths to the display units arranged at different operator control locations, and a relatively low voltage is used in said LVDS bus instead of the customary high voltages for digital systems. The video signals are transmitted continuously over the LVDS bus, with the result that different screen views, in which different operational variables or operational states can be displayed, are possible on the display units.

The operator control unit 15A" communicates with the centralized stored-program control device 16 or the centralized data processing device 17 via the back channel of the already existing LVDS bus 20A while the operator control unit 15B" transmits the data over a CAN bus 25.

The operator control units 15A" and 15B" can cooperate with the monitors 15A' and 15B' of the display units 15A and 15B insofar as certain functions which are assigned to the individual pushbutton keys, switches or regulators, if appropriate as a function of the operating state of the building machine, are displayed, for example in the form of graphic symbols, on the monitors. For example, different functions can be allocated to and represented visually on the pushbutton keys, switches or regulators.

A decisive advantage of the interaction of the display unit and data processing device is that by means of corresponding programming of the main processor 17A it is possible to change at any time the display unit on which the display is provided and to change what is displayed on the respective display unit and to change how it is displayed.

In order to monitor the production process, the building machine also has a device for recording 21 images, said device comprising a plurality of cameras 22. These cameras may be, for example, the cameras 11A, 11B, 11C and 11D in the road milling machine in FIG. 1 which has already been described.

Figure 2:
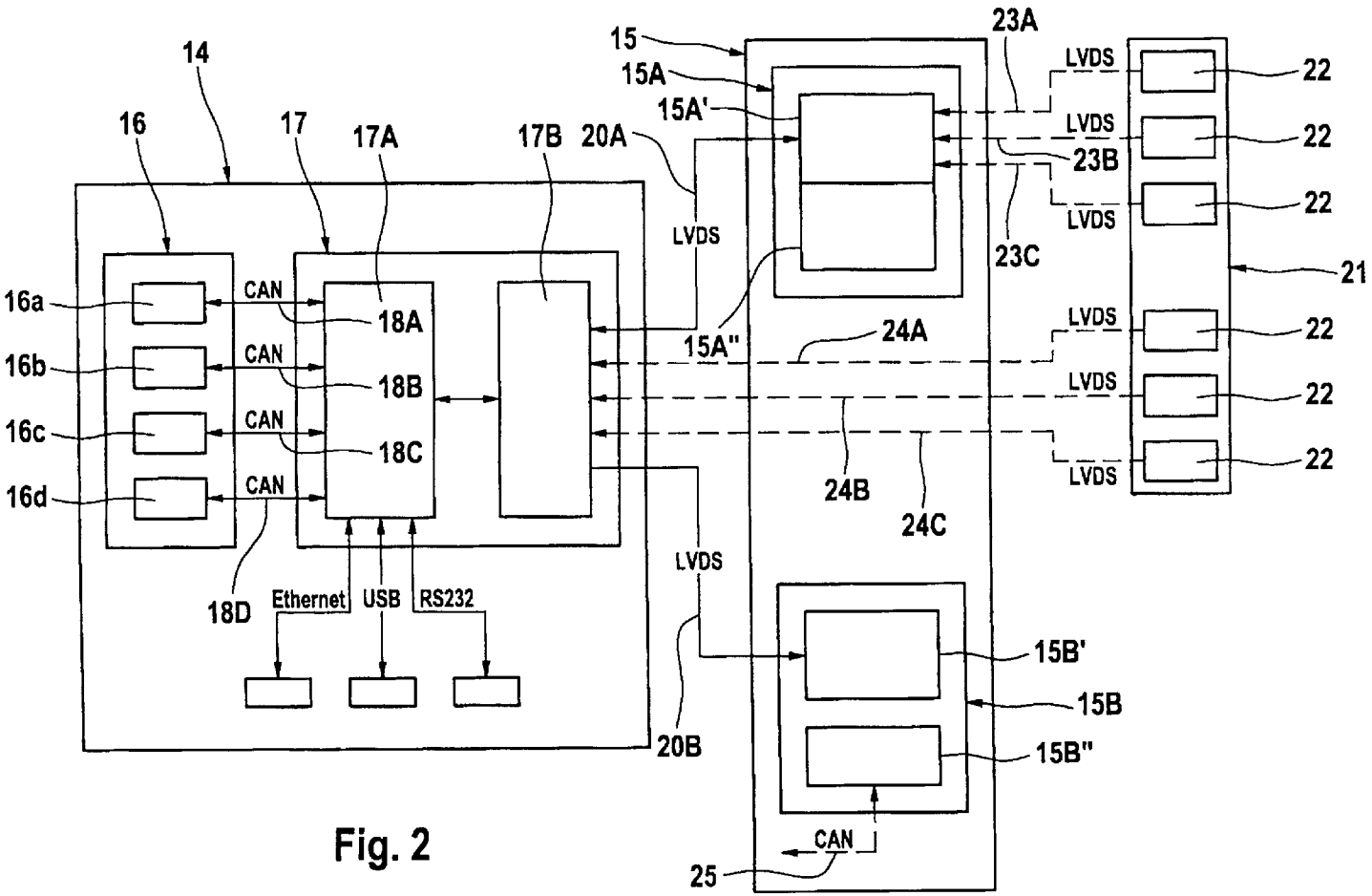
FIG. 2 is a schematic illustration of an example device according to the invention for controlling the building machine and for inputting and displaying operational variables or operational states.

In the exemplary embodiments illustrated in FIG. 2, in each case three cameras 22 are assigned directly to the display unit 15A, and three further cameras 22 are assigned to the display units 15A and 15B via the centralized data processing device 17.

The cameras 22 which are assigned to the display unit 15A are connected to the display unit 15A via an LVDS bus 23A, 23B, 23C so that the operator can observe the respective areas of the building machine on the TFT display of the display unit 15A. The driver of the machine can select between the images for one camera or the other, with it being possible to select the cameras with an input selector switch (not illustrated) which permits switching over between the different video signals of the cameras.

The cameras 22 which are assigned to the display unit 15B are connected over an LVDS bus 24A, 24B, 24C to the centralized data processing device 17. This has the advantage that signal processing, which permits, for example, a plurality of images to be displayed on one screen, is possible. Switching over between the individual cameras is not carried out here with input selector switches but rather with the operator control unit 15B" of the display unit 15B, which is connected to the centralized data processing device over the CAN bus 25. As a result, the operator has the possibility of controlling the screen display. Furthermore, the selection of the cameras can be carried out automatically here by the stored-program control device 16 or the centralized data processing device 17 as a function of the operating state of the building machine, without an input being necessary.

Using the specific exemplary embodiment of the road milling machine shown in FIG. 1, an explanation is given below of how the invention permits interaction between the stored-program control device 16 and the display units in conjunction with the recording device 21. While the machine is in the milling mode, the driver of the machine receives, for example via the display unit 15A, information about the data which relates to the machine or the operator control of the machine. For example, the driver can read off the advancing speed and the milling depth as well as the coolant temperature and the oil pressure on the monitor 15A' (display) of the display unit 15A. Alternatively, the driver of the machine can observe the working result by switching on the camera 11C on the operator control unit 15A" of the display unit 15A. In this context, the milling track immediately behind the milling device 5 can be displayed in a screen detail of the monitor 15A' of the display unit 15A.

If the driver of the machine engages the reverse gear, the main processor 17A receives a corresponding signal from the stored-program control device 16 over the CAN bus 18A. The main processor is programmed in such a way that just before the changeover of the direction of travel from forward travel to reverse travel the images of the camera 11D are automatically displayed to the driver of the machine so that he can observe the area behind the machine. If the machine has reached the starting point for the new milling section, the system switches over automatically to the camera 11B in order to be able to observe the movement path in the region of the milling roller 5A. If the driver of the vehicle then engages the forward gear again, the camera 11C is switched on again.

The exemplary embodiment shows that the display of characters and/or images can be changed with the display units 15A and 15B as a function of the operational variables or operational states. It is possible here to define, by means of a program, what is displayed, and when and how it is displayed. It is therefore possible to change the predefined values at any time with little expenditure, without having to modify the device 15 for displaying the characters and/or images as such.

The centralized data processing device 17 can also perform other functions as well as the generation of the data which is necessary for displaying the characters and images.

In the present exemplary embodiment the centralized data processing device 17 serves simultaneously as a server for the stored-program control device 16. It is therefore possible to read in programs and/or sets of parameters via an interface of the data processing device 17 in order to program the control device of the building machine.

For example, new programs and/or sets of parameters which are intended to replace the old programs and/or sets of parameters can be read in. However, in the event of a loss of data, it is also possible to read in new data via the interface of the data processing device 17.

The centralized data processing device 17 can also serve as a web server, with the result that it is possible to download machine documentation from the Internet and display it on the display unit. For example, spare parts lists, diagrams of hydraulics or operating instructions can be displayed.

Furthermore, the data processing device can establish a remote data transmission connection (RDT) in order to communicate with a control centre or some other machine. For example, the working results can be documented and transmitted to the control centre.

The efficiency of the data processing device 16 compared to the control device according to the prior art would also permit image processing to be carried out on the information acquired by means of the camera 22 in order to implement an access control system, in order to detect obstacles, to monitor the working process, to check the end result and to perform further related tasks.

While this invention has been particularly shown and described with references to example embodiments thereof, it will be understood by those skilled in the art that various changes in form and details may be made therein without departing from the scope of the invention encompassed by the appended claims.

What is claimed is:

1. A building machine, comprising:

a chassis;

a running gear supporting the chassis;

a working unit supported from the chassis and comprising one or more implements, each implement controlled by one or more actuators;

one or more sensors configured to provide output signals representative of an associated operation;

a Programmable Logic Controller (PLC) storing one or more programs and operational parameters and thereby configured to receive and process the output signals from the one or more sensors, and transmit control signals to the one or more actuators to control the operation of the working unit;

a display unit configured to display one or more operational variables of the machine or one or more operational states of the machine in the form of characters or images;

a central data processing unit including a main processor and a graphic unit, the central data processing unit being configured to control the display by the display unit of the one or more operational variables of the machine or the one or more operational states of the machine in the form of characters or images;

a first data bus connecting the central data processing unit with the PLC, the first data bus being configured to operate according to a first data transmission method; and a second data bus connecting the central data processing unit with the display unit, the second data bus being configured to operate according to a second data transmission method different from the first data transmission method.

2. The building machine of claim 1, wherein:

the first data bus is configured to provide an event-oriented transmission of data from the PLC relating to control of the machine in response to changes in operational variables or operational states; and the second data bus is configured to provide a continuous transmission of data to the display unit so that information about the operational variables or operational states is continuously displayed on the display unit.

3. The building machine of claim 2, wherein:

the first data bus includes a CAN (Controller Area Network) bus; and the second data bus includes an LVDS (Low Voltage Differential Signalling) bus.

4. The building machine of claim 1, wherein:

the first data bus is configured to provide an event-oriented transmission of data to the PLC so that the machine is controlled in response to changes in operational variables or operational states.

5. The building machine of claim 4, wherein:

the first data bus includes a CAN (Controller Area Network) bus.

6. The building machine of claim 1, wherein:

the second data bus is configured to provide a continuous transmission of data to the display unit so that information about the operational variables or operational states is continuously displayed on the display unit.

7. The building machine of claim 6, wherein:

the second data bus includes an LVDS (Low Voltage Differential Signalling) bus.

8. The building machine of claim 1, wherein:

the display unit is located at an operator control location of the building machine.

9. The building machine of claim 8, further comprising:

a second display unit located at a second operator control location.

10. The building machine of claim 1, further comprising:

an input device configured to input operational parameters or operational states to the machine.

11. The building machine of claim 1, further comprising:

a plurality of cameras located at a plurality of locations on the machine; and a third data bus connecting the plurality of cameras with the PLC.

12. The building machine of claim 1, further comprising:

a plurality of cameras located at a plurality of locations on the machine; and a third data bus connecting the plurality of cameras with the central data processing unit.

13. The building machine of claim 1, further comprising:

a direction sensor configured to sense a change in direction of travel of the machine; and wherein the PLC and the central data processing unit are configured to provide a first display of characters or images on the display unit before the change in the direction of travel and a second display of characters or images after the change in the direction of travel.

14. A method of controlling a building machine, the building machine including a chassis, a running gear supporting the chassis, a working unit supported from the chassis and comprising one or more implements each controllable by one or more actuators, and one or more sensors configured to provide output signals representative of an associated operation, the method comprising:

(a) controlling the operation of the working unit with a Programmable Logic Controller (PLC) storing one or more programs and operational parameters, the step of controlling the operation of the working unit further comprising a. receiving the output signals from the one or more sensors, b. processing the received output signals, and c. transmitting control signals to the one or more actuators;

(b) transmitting data regarding one or more operational parameters of the machine between the PLC and a central data processing unit over a first data bus operating according to a first data transmission method;

(c) generating video signals corresponding to the one or more operational parameters in a graphic unit of the central data processing unit, and transmitting the video signals to an electronic visual display over a second data bus operating according to a second data transmission method different from the first data transmission method; and (d) displaying the one or more operational parameters of the machine on the electronic visual display in the form of characters or images.

15. The method of claim 14, wherein the first data transmission method is an event-oriented data transmission method.

16. The method of claim 15, wherein the first data transmission method is a Carrier Sense Multiple Access/Collision Avoidance (CSMA/CA) transmission method conducted via a Controller Area Network (CAN) data bus.

17. The method of claim 15, wherein the second data transmission method is a continuous data transmission method.

18. The method of claim 17, wherein the continuous data transmission method is conducted via a Low Voltage Differential Signaling (LVDS) data bus.

19. A building machine comprising:

a chassis;

a working unit supported from the chassis and comprising one or more implements, each implement controlled by one or more actuators;

one or more sensors configured to provide output signals representative of an associated operation;

a Programmable Logic Controller (PLC) arranged within the chassis and storing one or more programs and operational parameters, the PLC configured to receive and process the output signals from the one or more sensors, and transmit control signals to the one or more actuators;

a display unit arranged at an operator control location associated with the machine;

a server arranged within the chassis and configured to read in or replace one or more of the one or more programs and operational parameters in the PLC via event-oriented data transmission across a first data bus, and control a display by the display unit of one or more operational variables of the machine or one or more operational states of the machine in the form of characters or images, via continuous data transmission across a second data bus.

20. The building machine of claim 19, wherein the event-oriented data transmission comprises a Carrier Sense Multiple Access/Collision Avoidance (CSMA/CA) transmission method conducted via a Controller Area Network (CAN) data bus.

21. The building machine of claim 20, wherein the second data bus is a Low Voltage Differential Signaling (LVDS) data bus.

* * * * *